US008668448B2

(12) United States Patent
Farah et al.

(10) Patent No.: US 8,668,448 B2
(45) Date of Patent: Mar. 11, 2014

(54) AIRFOIL ATTACHMENT ARRANGEMENT

(75) Inventors: Jorge I. Farah, Hartford, CT (US); Jaisukhlal V. Chokshi, Palm Beach Gardens, FL (US)

(73) Assignee: United Technologies Corporation, Hartford, CT (US)

( * ) Notice: Subject to any disclaimer, the term of this patent is extended or adjusted under 35 U.S.C. 154(b) by 679 days.

(21) Appl. No.: 12/915,575

(22) Filed: Oct. 29, 2010

(65) Prior Publication Data

US 2012/0107124 A1 May 3, 2012

(51) Int. Cl.
*F01D 5/32* (2006.01)

(52) U.S. Cl.
USPC ..... 415/209.4; 415/210.1; 416/220 R

(58) Field of Classification Search
USPC ..... 415/189, 190, 209.2, 209.3, 209.4, 415/210.1; 416/214 A, 214 R, 220 R; 29/889.1, 889.21, 889.22
See application file for complete search history.

(56) References Cited

U.S. PATENT DOCUMENTS

| | | | | |
|---|---|---|---|---|
| 2,980,396 | A * | 4/1961 | Movsesian | 415/189 |
| 3,057,598 | A | 10/1962 | Boyle et al. | |
| 4,498,790 | A * | 2/1985 | Fisher | 384/428 |
| 4,749,333 | A | 6/1988 | Bonner et al. | |
| 5,078,576 | A | 1/1992 | Hayton | |
| 5,277,548 | A * | 1/1994 | Klein et al. | 416/193 A |
| 5,399,069 | A * | 3/1995 | Marey et al. | 415/209.3 |
| 6,902,375 | B2 | 6/2005 | Bird | |
| 7,052,234 | B2 * | 5/2006 | Wells et al. | 415/137 |
| 7,125,222 | B2 * | 10/2006 | Cormier et al. | 415/160 |
| 7,722,321 | B2 | 5/2010 | Lhoest et al. | |
| 8,206,100 | B2 * | 6/2012 | Schuler et al. | 415/209.4 |
| 2010/0054932 | A1 | 3/2010 | Schiavo | |

* cited by examiner

*Primary Examiner* — Edward Look
*Assistant Examiner* — Liam McDowell
(74) *Attorney, Agent, or Firm* — Carlson, Gaskey & Olds P.C.

(57) ABSTRACT

An example airfoil retention arrangement includes a retention assembly having a first retention segment and a second retention segment. Each of the retention segments is separately moveable to an installed position relative to an airfoil assembly and a support structure. The retention segments each have a portion position between a lip of the airfoil assembly and a collar of the support structure when the retention segments are in the installed position. The retention assembly is configured to limit radial movement of an airfoil relative to the support structure when in the installed position.

16 Claims, 8 Drawing Sheets

AIRFOIL ATTACHMENT ARRANGEMENT

BACKGROUND

This disclosure relates generally to a turbomachine and, more particularly, to securing an airfoil within a turbomachine.

As known, turbomachines include multiple sections, such as a fan section, a compression section, a combustor section, a turbine section, and an exhaust nozzle section. The compression section and the turbine section include airfoil arrays distributed circumferentially about an engine axis. The airfoil arrays include multiple individual airfoils, which extend radially relative to the engine axis. Some airfoil arrays in the turbomachine are configured to rotate about the engine axis during operation. Other airfoil arrays in the turbomachine are configured to remain stationary during operation.

Air moves into the turbomachine through the fan section. The combustion section compresses this air. The compressed air is then mixed with fuel and combusted in the combustor section. The products of combustion are expanded to rotatably drive airfoil arrays in the turbine section. Rotating the airfoil arrays in the turbine section drives rotation of the fan section.

Airfoils are exposed to extreme temperatures and pressures within the turbomachine. Attachment strategies for securing the airfoils must withstand the temperature and pressure extremes. Airfoils periodically become damaged and require repair or replacement. Non mechanical attachment methods such as welding or brazing the airfoils to secure the airfoils inhibits later repair or replacement of the airfoil.

SUMMARY

An example airfoil retention arrangement includes a retention assembly having a first retention segment and a second retention segment. Each of the retention segments is separately moveable to an installed position relative to an airfoil assembly and a support structure. The retention segments each have a portion positioned between a lip of the airfoil assembly and a collar of the support structure when the retention segments are in the installed position. The retention assembly is configured to limit radial movement of an airfoil relative to the support structure when in the installed position.

Another example turbomachine airfoil assembly includes an outer platform and an inner platform. At least one airfoil assembly extends radially between the outer platform and the inner platform. A retention assembly is configured to limit radial movement of the airfoil assembly relative to the outer platform or the inner platform when the retention assembly is in the installed position. The retention assembly is slidably received within at least one slot established by the outer platform or the inner platform when the retention assembly is in the installed position.

These and other features of the disclosed examples can be best understood from the following specification and drawings, the following of which is a brief description.

DETAILED DESCRIPTION

Figure 1:
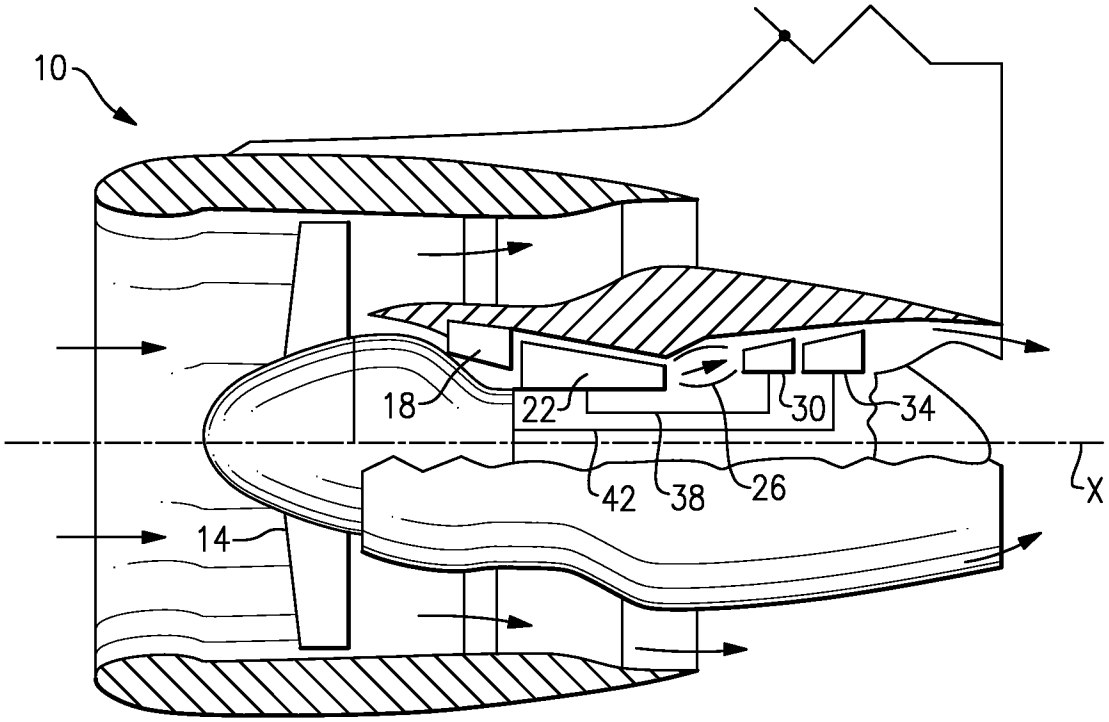
FIG. 1 shows a schematic view of an example gas turbine engine.

FIG. 1 schematically illustrates an example gas turbine engine 10 including (in serial flow communication) a fan 14, a low pressure compressor 18, a high pressure compressor 22, a combustor 26, a high pressure turbine 30, and a low pressure turbine 34. The gas turbine engine 10 is circumferentially disposed about an engine centerline X (i.e., engine axis). The gas turbine engine 10 is an example turbomachine.

During operation, air is pulled into the gas turbine engine 10 by the fan 14, pressurized by the compressors 18 and 22, mixed with fuel, and burned in the combustor 26. The turbines 30 and 34 extract energy from the hot combustion gases flowing from the combustor 26. In a two-spool design, the high pressure turbine 30 utilizes the extracted energy from the hot combustion gases to power the high pressure compressor 22 through a high speed shaft 38. The low pressure turbine 34 utilizes the extracted energy from the hot combustion gases to power the low pressure compressor 18 and the fan 14 through a low speed shaft 42.

The examples described in this disclosure are not limited to the two-spool engine architecture described and may be used in other architectures, such as a single spool axial design, a three-spool axial design, and still other architectures. That is, there are various types of engines, and other turbomachines, that can benefit from the examples disclosed herein.

Figure 2:
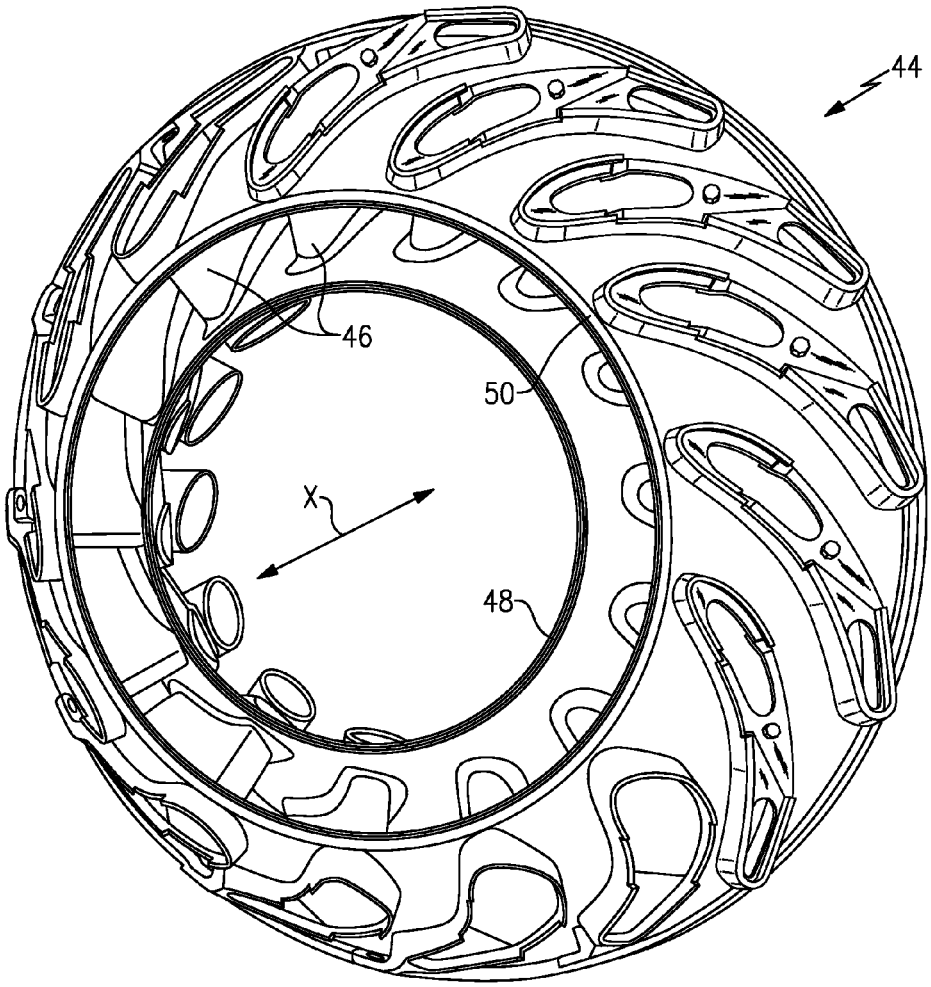
FIG. 2 shows an example airfoil arrangement from a turbine section of the FIG. 1 engine.
Figure 3:
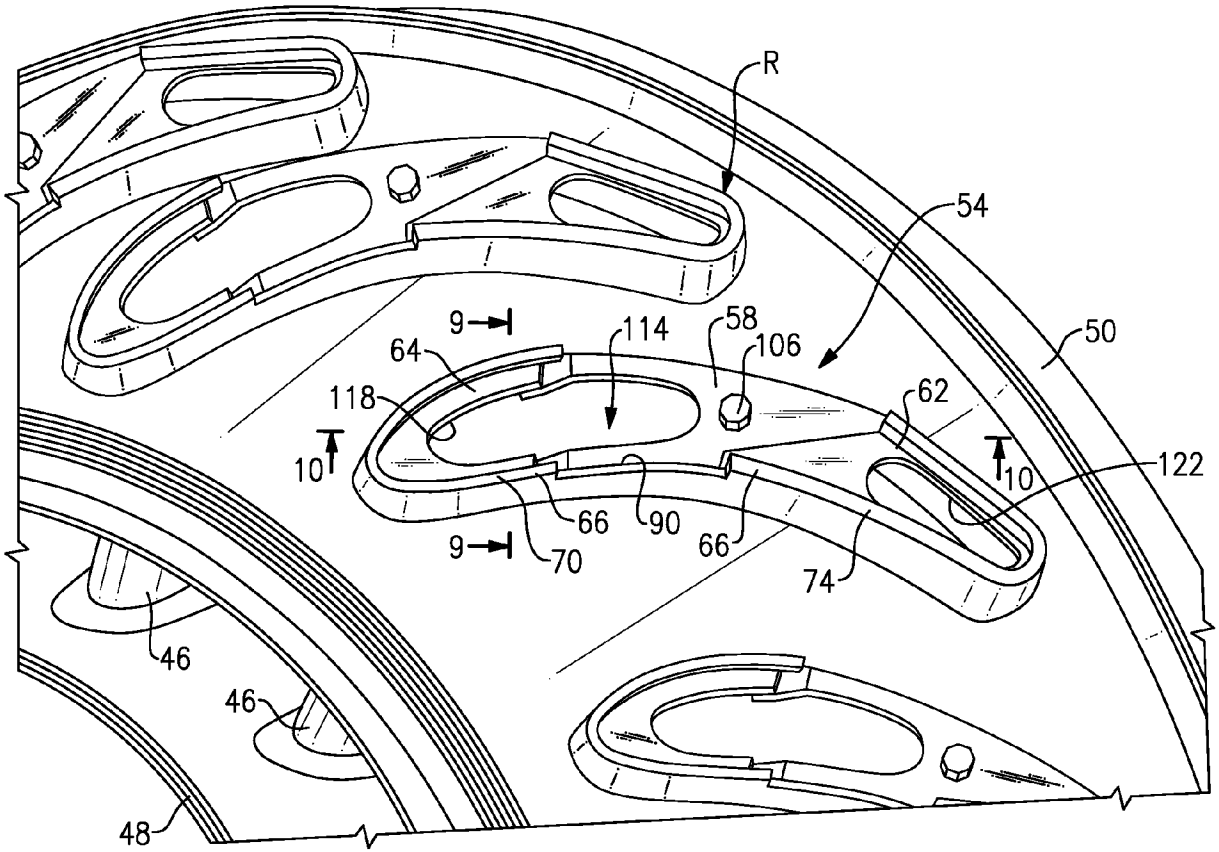
FIG. 3 shows a close-up view of a portion of the FIG. 2 airfoil arrangement showing an example retention assembly in an installed position.
Figure 4:
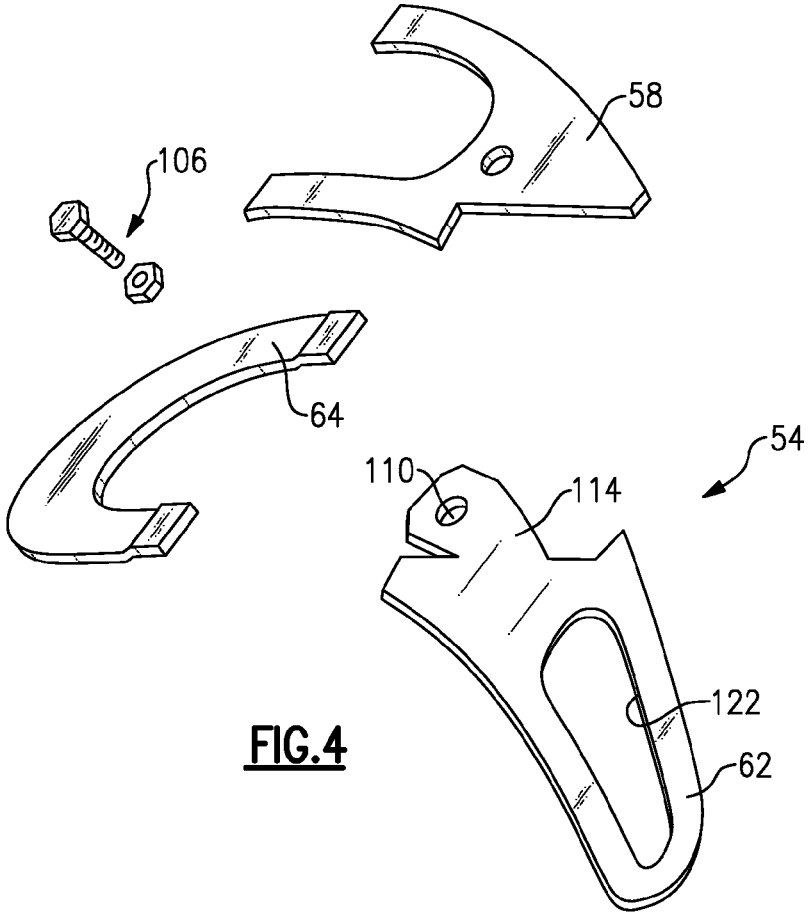
FIG. 4 shows an exploded view of the FIG. 3 retention assembly.
Figure 5:
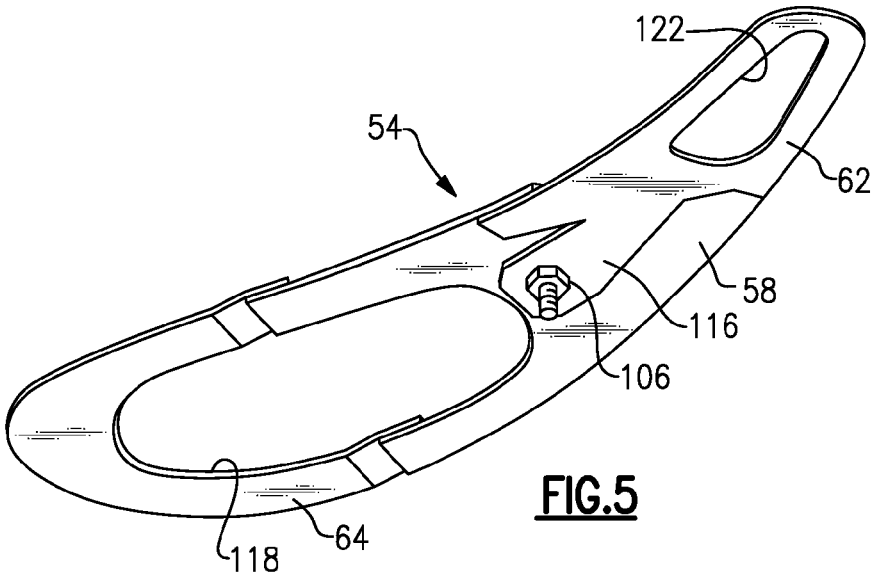
FIG. 5 shows a view of the underside of the FIG. 3 retention assembly.
Figure 7:
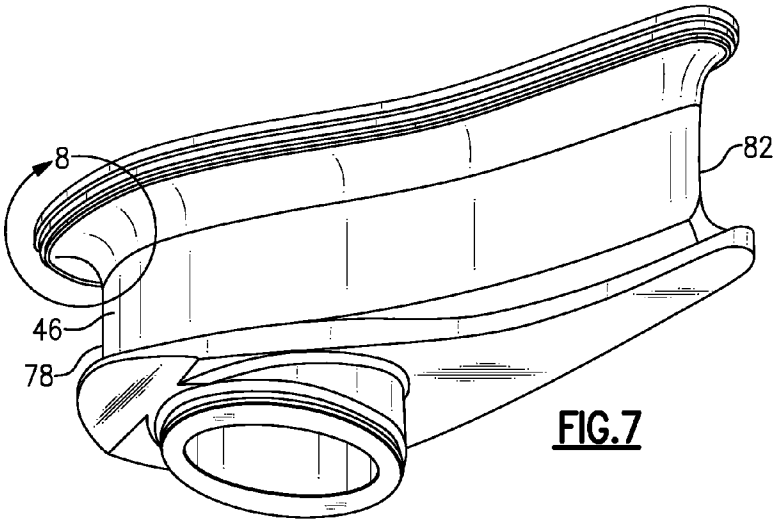
FIG. 7 shows a perspective view of the FIG. 6 airfoil from a radially inner position.
Figure 8:
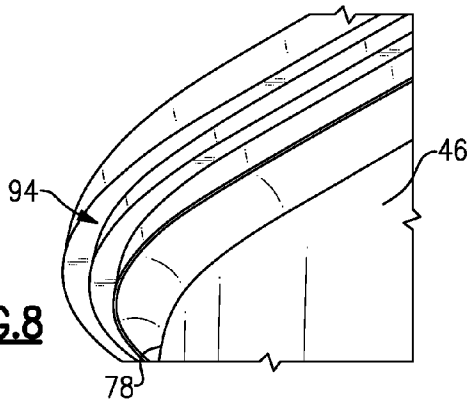
FIG. 8 shows a close-up view of a leading edge portion of the FIG. 6 airfoil at radially outer position.
Figure 6:
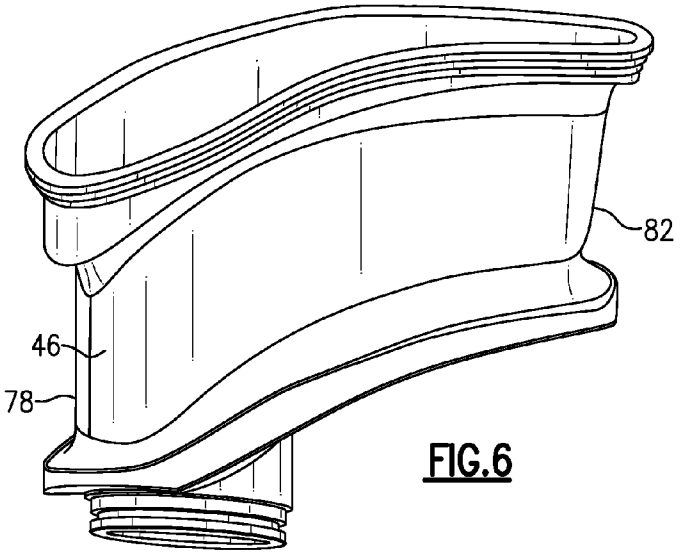
FIG. 6 shows a perspective view of an airfoil assembly in the FIG. 2 airfoil arrangement from a radially outer position.
Figure 9:
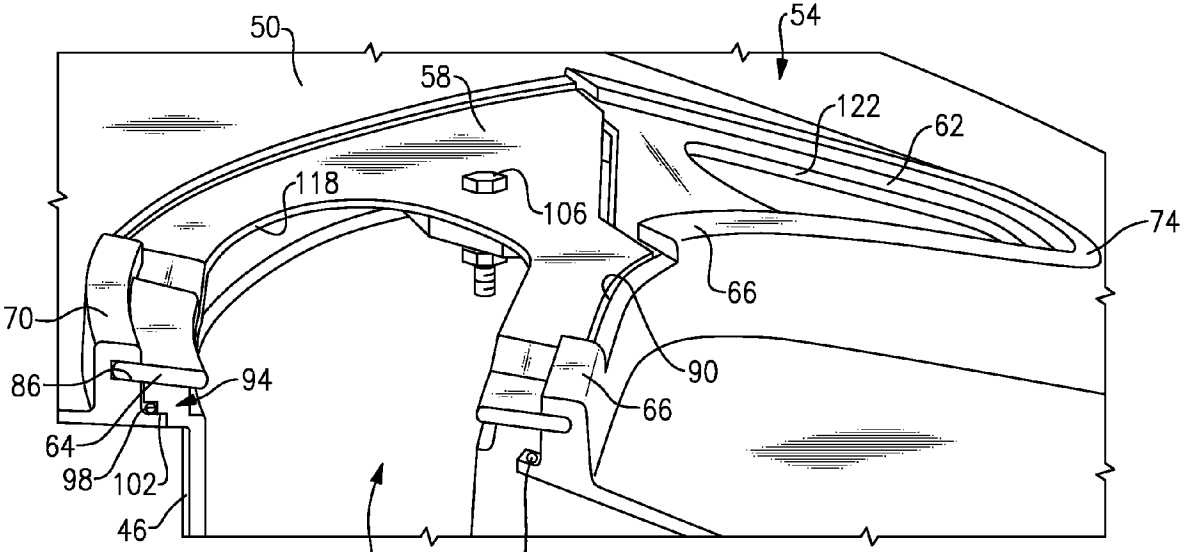
FIG. 9 shows a section view at line 9-9 in FIG. 3.
Figure 10:
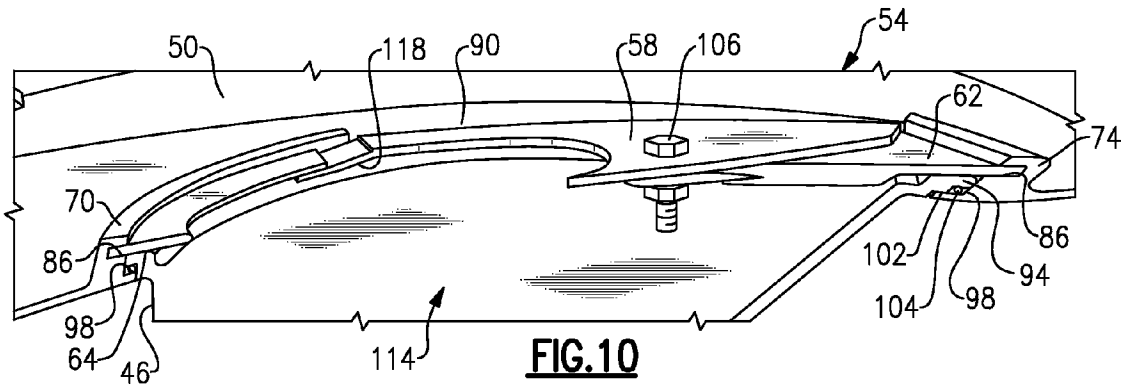
FIG. 10 shows a section view at line 10-10 in FIG. 3.

Referring to FIG. 2, an example airfoil arrangement 44 from the engine 10 includes a plurality of airfoil assemblies 46 extending radially from an inner platform 48 to an outer platform 50. The inner platform 48 and the outer platform 50 are each platform rings that act as support structures for the airfoil assemblies 46.

The example airfoil assemblies 46 are turbine vanes that do not rotate. Other areas of the engine 10 include airfoil assemblies that rotate.

Referring now to FIGS. 3-10 with continued reference to FIG. 2, an example retention assembly 54 limits radial movement of the airfoil assembly 46 relative to the outer platform 50. The example retention assembly 54 includes a first retention segment 58, a second retention segment 62, and a third retention segment 64.

The outer platform 50 includes a collar 66 that holds the radial position of the retention assembly 54. The collar 66 includes a first sub-collar 70 and a second sub-collar 74. The first sub-collar 70 is associated with a leading edge 78 of the airfoil assembly. The second sub-collar 74 is associated with a trailing edge 82 of the airfoil assembly 46. The first sub-collar 70 and the second sub-collar 74 each establish a slot 86 that slidably receives the respective portions of the retention assembly 54.

During assembly, the airfoil assembly 46 is moved in a direction R through an aperture 90 established by the outer platform 50. A lip 94 of the airfoil assembly 46 then contacts a ledge 98 of the outer platform 50. The example ledge 98 extends around the entire aperture 90. The contact between a surface 102 of the lip 94 and the ledge 98 limits further radial movement of the airfoil assembly 46 toward the centerline X.

After the surface 102 contacts the ledge 98, the retention assembly 54 is moved into an installed position relative to the outer platform 50 and the airfoil assembly 46. In this example, the second retention segment 62 is received within the slot 86 established by the second sub-collar 74 when the retention assembly 54 is in the installed position. Also, the first retention segment 58 and the third retention segment 64 are at least partially received within the slot 86 established by the first sub-collar 70 when the retention assembly 54 is in the installed position. A rope seal 104 extends between the ledge 98 and the lip 94 in this example. The rope seal 104 enhances the seal at the interface between the ledge 98 and the lip 94.

As can be appreciated, the collar 66 limits radial movement of the retention assembly 54 when the retention assembly 54 is in the installed position. The retention assembly 54 limits radial movement of the airfoil assembly away from the axis when the retention assembly 54 is in the installed position. The example retention assembly 54 effectively closes the aperture 90, which prevent the airfoil assembly 46 from moving relative to the outer platform 50 away from the centerline X.

In this example, a mechanical fastener 106 is received within an aperture 110 established by the first retention segment 58 and the second retention segment 62. The mechanical fastener 106 secures the first retention segment 58 and the second retention segment 62 and effectively prevents movement of the second retention segment 62 away from the slot 86 established in the second sub-collar 74.

A locking tab 116 portion of the second retention segment 62 extends underneath the first retention segment 58 establishes a portion of the aperture 110 in this example. When the first retention segment 58 is secured relative to the second retention segment 62 in the installed position, the first retention segment 58 locks movement of the third retention segment 64 away from the slot 86 established in the first sub-collar 70.

Positioning the mechanical fastener 106 within the aperture 90 positions the mechanical fastener 106 within the cooling airfoil and away from hotter areas of the engine 10. As known, cooling airflow moves through the aperture 90 to an interior 114 of the airfoil assembly 46 during operation of the engine 10. The example retention segments 58, 62, and 64 are made of a nickel, such as WASPALOY®, in this example. The retention segments 58, 62, and 64 grow thermally with the surrounding components.

The retention assembly 54 establishes apertures 118 and 122 when in the installed position. The apertures 118 and 122 facilitate communicating air to the interior 114 of the airfoil assembly 46.

A repair and replacement procedure involving the retention assembly 54 involves removing the mechanical fastener 106 so that the retention segments 58, 62, and 64 may be moved relative to each other and withdrawn from the slot 86. After removing the retention assembly 54 from the slot 86, the airfoil assembly 46 is free to move radially relative to the outer platform 50 back through the aperture 90.

Figure 11:
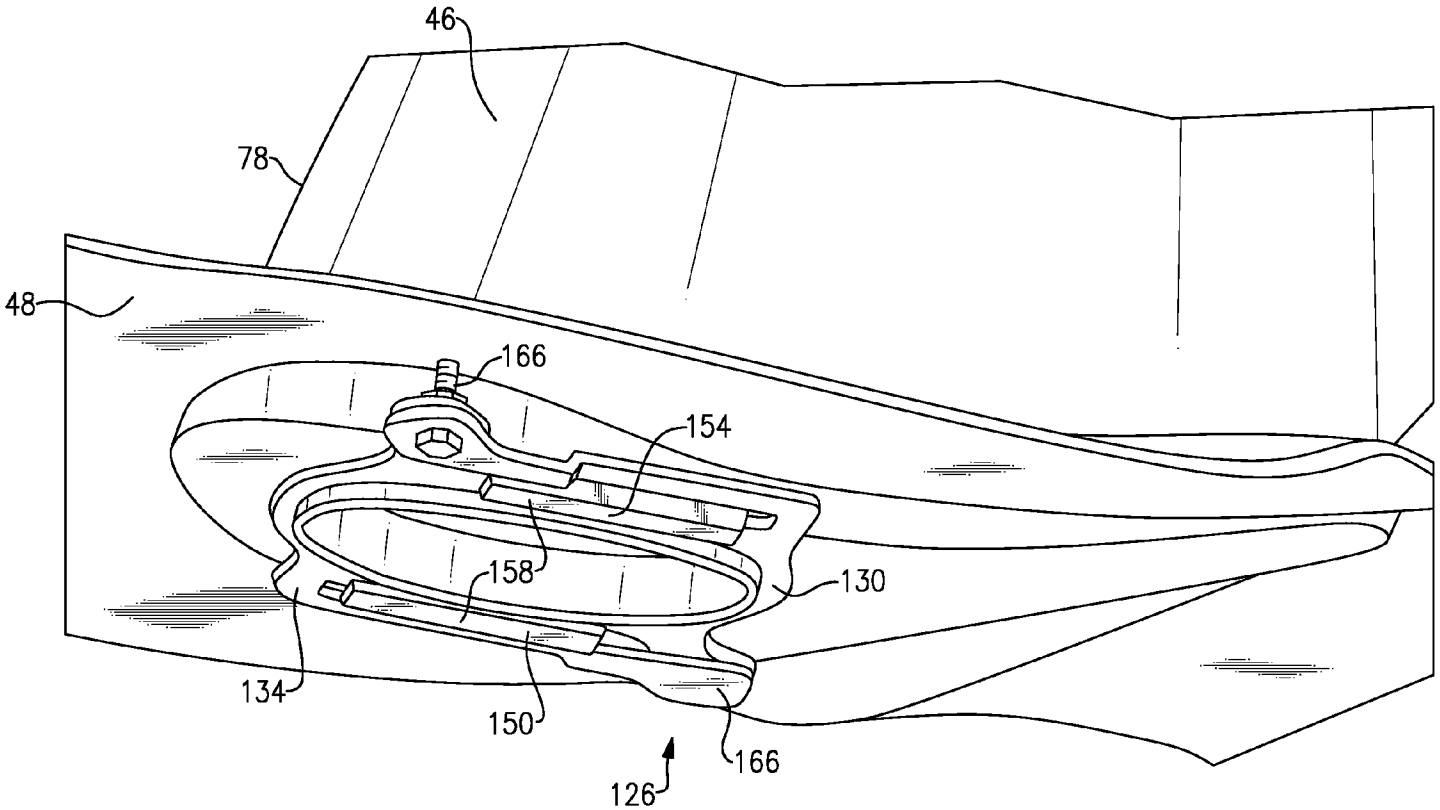
FIG. 11 shows a close-up view of another portion of the FIG. 2 airfoil arrangement showing another airfoil retention assembly in an installed position.
Figure 13:
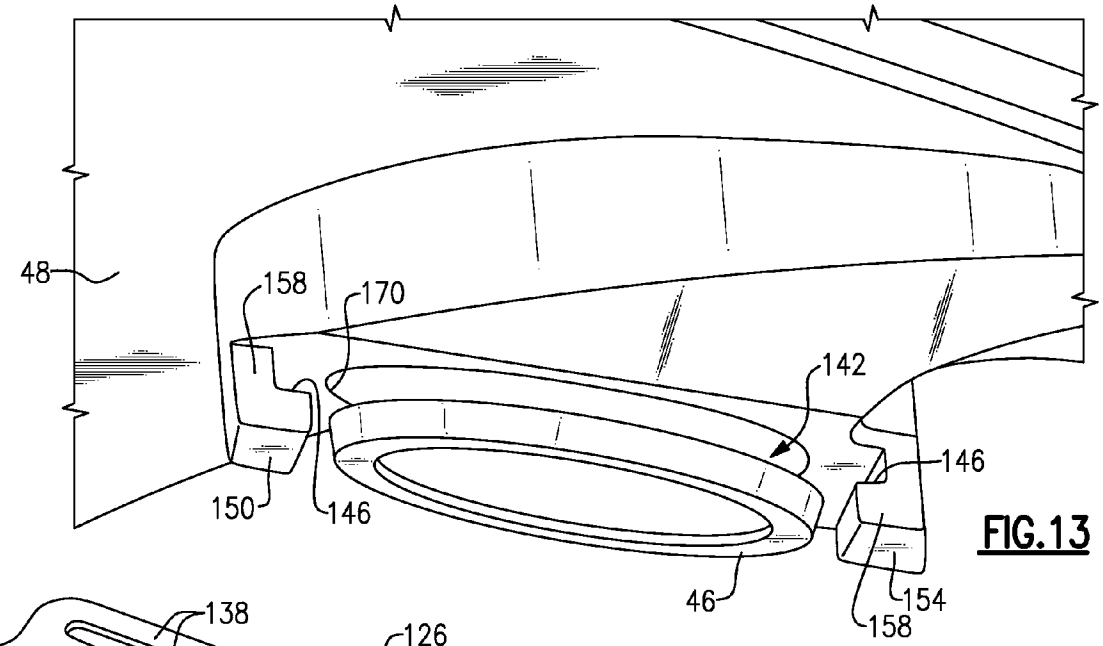
FIG. 13 shows the FIG. 11 airfoil assembly and support structure without the retention assembly.
Figure 12:
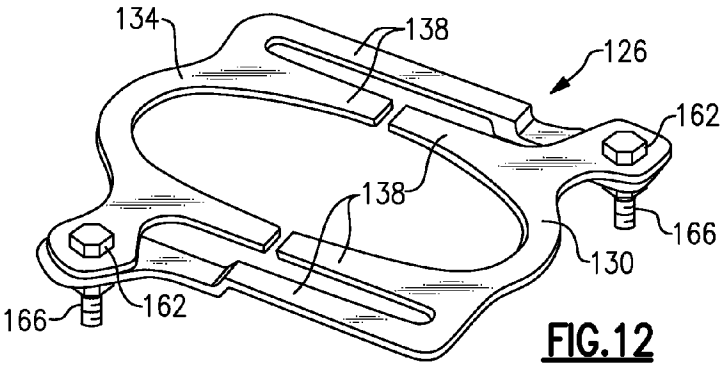
FIG. 12 shows a perspective view of the FIG. 11 retention assembly.

Referring now to FIGS. 11-13, another example retention assembly 126 includes a first retention segment 130 and a second retention segment 134. The retention segments 130 and 134 each include a plurality of fingers 138. When the retention assembly 126 is in an installed position (FIG. 11), the fingers 138 are received within a groove 142 established in a radially inner end of the airfoil assembly 46. When the retention assembly 126 is in an installed position, the fingers 138 are also received within a slot 146 and the retention assembly 126 straddles a portion of the airfoil assembly 46.

A first flange 150 establishes a portion of the slot 146. A second flange 154 establishes another portion of the slot 146. The first flange 150 and the second flange 154 are hook-shaped flanges in this example. The first flange 150 and the second flange 154 form portions of a collar 158 in the inner platform 48 of the airfoil arrangement 44. The first flange 150 and the second flange 154 hold the retention assembly 126 in the installed position relative to the inner platform.

As can be appreciated, when the retention assembly 126 is in the installed position, contact between the edges of the grooves 142 and the fingers 138 limits radial movement of the airfoil assembly 46 relative to the inner platform 48.

Apertures 162 established in the retention segments 130 and 134 receive a mechanical fastener 166, which secures the first retention segment 130 relative to the second retention segment 134. In this example, the apertures 162 and the mechanical fastener 166 have a radially extending axis. In another example, the aperture 162 and the mechanical fastener 166 have an axis transverse to a radial direction. For example, the aperture 162 and the mechanical fastener 166 could be rotated 90° from the position shown in the figures for packaging reasons, etc.

During assembly of the airfoil assembly 46 relative to the inner platform 48, a radially inner end of the airfoil assembly 46 is received within an aperture 170 established in the inner platform. The retention segment 130 and the retention segment 134 are then moved to an installed position relative to the airfoil assembly 46.

Again, contact between the fingers 138 and the first flange 150 and the second flange 154 limits radial movement of the airfoil assembly 46 toward the axis. The fingers 138 also prevent the airfoil assembly 46 from moving back through the aperture 170. The fingers 138 effectively close the aperture 170, which prevents the airfoil assembly 46 from retracting back through the aperture 170.

Features of the disclosed examples include facilitating assembly and disassembly of the airfoil assembly relative to a support structure, such as an inner platform or an outer platform. The attachment strategies occupy a relatively small area within the turbomachine and spread load over a relatively large contact area.

The preceding description is exemplary rather than limiting in nature. Variations and modifications to the disclosed examples may become apparent to those skilled in the art that do not necessarily depart from the essence of this disclosure. Thus, the scope of legal protection given to this disclosure can only be determined by studying the following claims.

We claim:

1. An airfoil retention arrangement comprising:

a retention assembly including a first retention segment and a second retention segment each separately moveable to an installed positioned relative to an airfoil assembly and a support structure, the first retention segment and the second retention segment each having a portion positioned between a lip of the airfoil assembly and a collar of the support structure when in the installed position, wherein the retention assembly is configured to limit radial movement of the airfoil assembly relative to the support structure when in the installed position, wherein the support structure is a platform ring having an axis, the platform ring having a ledge extending about at least a portion of an aperture established within the platform ring, wherein radial movement of the airfoil assembly in a first direction is limited by the ledge, and radial movement of the airfoil assembly in a second direction is limited by the retention assembly, the first direction opposite the second direction, and wherein the lip is between the ledge and the retention assembly.

2. The airfoil retention arrangement of claim 1, including at least one mechanical fastener configured to hold the first retention segment and the second retention segment relative to each other.

3. The airfoil retention arrangement of claim 1, wherein the airfoil is a turbine vane.

4. The airfoil retention arrangement of claim 1, wherein the support structure is a platform ring.

5. The airfoil retention arrangement of claim 1, wherein the collar comprises a first sub-collar associated with a leading edge of the airfoil and a separate, second sub-collar associated with the trailing edge of the airfoil, the first sub-collar and the second sub-collar configured to limit radial movement of the retention assembly when the retention assembly is in the installed position.

6. The airfoil retention arrangement of claim 5, including a third retention segment moveable to an installed positioned relative to the airfoil assembly and the support structure, wherein portions of the first retention segment and the second retention segment are positioned between the second sub-collar and the airfoil when in the installed position, and portions of the third retention segment and the second retention segment are positioned between the first sub-collar and the airfoil when in the installed position.

7. The airfoil retention arrangement of claim 1, wherein the collar comprises a first flange and a second flange, the first flange and the second flange configured to limit radial movement of the retention assembly when the retention assembly is in the installed position.

8. The airfoil retention arrangement of claim 7, wherein the first retention segment and the second retention segment each include at least one finger that is at least partially received within a groove established by the airfoil when the retention assembly is in the installed position, contact between the airfoil assembly and the at least one finger limiting radial movement of the airfoil assembly.

9. The airfoil retention arrangement of claim 8, wherein the retention assembly includes at least one aperture that is configured to receive at least one mechanical fastener that is configured to hold the first retention segment relative to the second retention segment.

10. The airfoil retention arrangement of claim 9, wherein the at least one mechanical fastener extends generally parallel to the airfoil when received within the at least one aperture.

11. An airfoil retention arrangement comprising:

a retention assembly including a first retention segment and a second retention segment each separately moveable to an installed positioned relative to an airfoil assembly and a support structure, the first retention segment and the second retention segment each having a portion positioned between a lip of the airfoil assembly and a collar of the support structure when in the installed position, wherein the retention assembly is configured to limit radial movement of the airfoil assembly relative to the support structure when in the installed position, the support structure is a platform ring having an axis platform ring having a ledge extending about at least a portion of an aperture established within the platform ring, wherein the contact between the lip of the airfoil assembly and the ledge limits relative radial movement of the airfoil assembly toward the axis; and a surface of the lip that faces the axis is configured to contact the ledge and a surface of the lip that faces away from the axis is configured to contact the retention assembly when the retention assembly is in the installed position.

12. An airfoil retention arrangement comprising:

a retention assembly including a first retention segment and a second retention segment each separately moveable to an installed positioned relative to an airfoil assembly and a support structure, the first retention segment and the second retention segment each having a portion positioned between a lip of the airfoil assembly and a collar of the support structure when in the installed position, wherein the retention assembly is configured to limit radial movement of the airfoil assembly relative to the support structure when in the installed position, the support structure is a platform ring having an axis, the platform ring having a ledge extending about at least a portion of an aperture established within the platform ring, wherein the contact between the lip of the airfoil assembly and the ledge limits relative radial movement of the airfoil assembly toward the axis; and at least one mechanical fastener configured to hold the first retention segment and the second retention segment relative to each other, wherein the mechanical fastener extends into the aperture and within the airfoil assembly.

13. A turbomachine airfoil assembly, comprising:

an outer platform;

an inner platform;

at least one airfoil assembly extending radially between the outer platform and the inner platform, the at least one airfoil assembly including a lip; and a retention assembly configured to limit radial movement of the at least one airfoil assembly relative to one of the outer platform or the inner platform when the retention assembly is in the installed position, wherein the retention assembly is slidably received within at least one slot established by the one of the outer platform or the inner platform when the retention assembly is in the installed position, wherein the inner platform or the outer platform has a ledge extending about at least a portion of an aperture, wherein radial movement of the at least one airfoil assembly in a first direction is limited by the ledge, and radial movement of the at least one airfoil assembly in a second direction is limited by the retention assembly, the first direction opposite the second direction, and wherein the lip is between the ledge and the retention assembly.

14. The turbomachine airfoil assembly of claim 13, comprising a second retention assembly configured to limit radial movement of the at least one airfoil assembly relative to the other of the inner platform or the outer platform when the retention assembly is in the installed position, wherein the retention assembly is slidably received within at least one slot established by the other of the outer platform or the inner platform when the retention assembly is in the installed position.

15. The turbomachine airfoil assembly of claim 14, wherein the at least one slot established by the other of the outer platform of the inner platform comprises a first hook-shaped flange and a second hooked-shaped flange separate from the first hook-shaped flange, the second retention assembly contacting the first hook-shaped flange and the second hook-shaped flange to limit radial movement of the at least one airfoil assembly toward an axis established by the inner platform.

16. The turbomachine airfoil assembly of claim 14, wherein the second retention assembly is further slidably received within a groove established in the airfoil assembly.

* * * * *

UNITED STATES PATENT AND TRADEMARK OFFICE

CERTIFICATE OF CORRECTION

PATENT NO. : 8,668,448 B2
APPLICATION NO. : 12/915575
DATED : March 11, 2014
INVENTOR(S) : Jorge I. Farah et al.

It is certified that error appears in the above-identified patent and that said Letters Patent is hereby corrected as shown below:

IN THE CLAIMS:

Column 6, claim 11, line 1: delete "axis platform" and replace with --axis, the platform--

Signed and Sealed this
Twentieth Day of May, 2014

Michelle K. Lee

Michelle K. Lee
*Deputy Director of the United States Patent and Trademark Office*